US005647584A

United States Patent [19]

Beaudreau et al.

[11] Patent Number: 5,647,584

[45] Date of Patent: Jul. 15, 1997

[54] SHEET FEEDER

[75] Inventors: Cherilyn M. Beaudreau, Satellite Beach; David C. Bailey, Cocoa Beach; Jon E. Holmes, West Melbourne; Warren H. Miller, Palm Bay, all of Fla.

[73] Assignee: Harris Corporation, Melbourne, Fla.

[21] Appl. No.: 346,265

[22] Filed: Nov. 23, 1994

[51] Int. Cl.[6] ..... B65H 3/52; B65H 3/56

[52] U.S. Cl. ..... 271/122; 271/188

[58] Field of Search ..... 271/110, 121, 271/122, 188, 262, 263, 265.04, 272, 902

[56] References Cited

U.S. PATENT DOCUMENTS

| | | | |
|---|---|---|---|
| 4,451,027 | 5/1984 | Alper | 271/122 X |
| 4,589,650 | 5/1986 | Miyoshi | 271/122 X |
| 4,858,905 | 8/1989 | Weigel | 271/122 X |
| 5,026,043 | 6/1991 | Tanjo et al. | 271/122 X |
| 5,152,522 | 10/1992 | Yamashita | 271/188 X |
| 5,316,284 | 5/1994 | Bolognese et al. | 271/121 |
| 5,351,945 | 10/1994 | Asakawa et al. | 271/122 X |
| 5,449,162 | 9/1995 | Saito et al. | 271/122 |

FOREIGN PATENT DOCUMENTS

| | | | |
|---|---|---|---|
| 0379661 | 8/1990 | European Pat. Off. | 271/122 |
| 9198242 | 11/1984 | Japan | 271/122 |
| 9212337 | 12/1984 | Japan | 271/122 |
| 60-56742 | 4/1985 | Japan | 271/122 |
| 1214537 | 8/1989 | Japan | 271/122 |
| 4089732 | 3/1992 | Japan | 271/122 |

*Primary Examiner*—Karen B. Merritt
*Assistant Examiner*—Scott L. Lowe
*Attorney, Agent, or Firm*—Rogers & Killeen

[57] ABSTRACT

A sheet feeder may include a feed roller for compelling a sheet from a stack of sheets into a sheet path and a pair of separation rollers rotating in the same direction for urging sheets along the sheet path. The separation rollers may be selectively and separately disengaged from their motive source in coordination with operation of a motor for the feed roller to provide multiple checks for sheet multifeeds. At each check, extra sheets are returned to the stack of sheets. The separation rollers may each include plural annular spaced-apart sheet contact surfaces that are interleaved with the contact surfaces of the other roller.

16 Claims, 7 Drawing Sheets

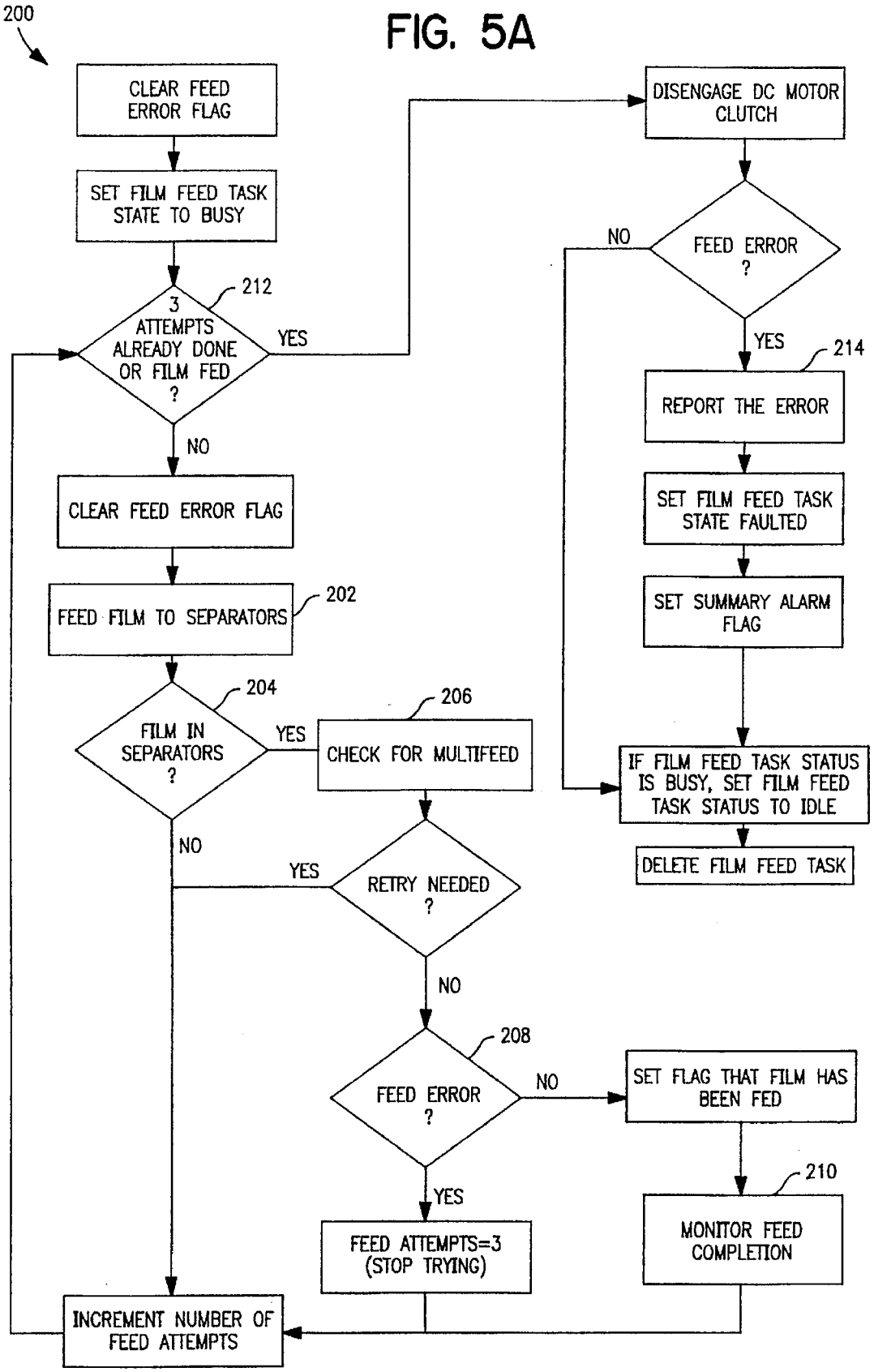
200
FIG. 5A
CLEAR FEED ERROR FLAG
SET FILM FEED TASK STATE TO BUSY
3 ATTEMPTS ALREADY DONE OR FILM FED ?
212
YES
NO
CLEAR FEED ERROR FLAG
FEED FILM TO SEPARATORS
202
FILM IN SEPARATORS ?
204
YES
NO
CHECK FOR MULTIFEED
206
RETRY NEEDED ?
YES
NO
FEED ERROR ?
208
NO
YES
SET FLAG THAT FILM HAS BEEN FED
MONITOR FEED COMPLETION
210
FEED ATTEMPTS=3 (STOP TRYING)
INCREMENT NUMBER OF FEED ATTEMPTS
DISENGAGE DC MOTOR CLUTCH
FEED ERROR ?
NO
YES
REPORT THE ERROR
214
SET FILM FEED TASK STATE FAULTED
SET SUMMARY ALARM FLAG
IF FILM FEED TASK STATUS IS BUSY, SET FILM FEED TASK STATUS TO IDLE
DELETE FILM FEED TASK

SHEET FEEDER

BACKGROUND OF THE INVENTION

The present invention relates to sheet feeders, and more particularly to methods and systems for feeding film sheets from a stack of film sheets in which multisheet feeding is avoided.

Sheet feeders desirably provide individual sheets one at a time from a stack of sheets into a sheet path that conveys the sheets to an operating stage, such as an imaging device. The term "sheet" as used herein refers to a relatively thin, flat, and generally rectangular flexible piece, including without limitation, photosensitive material (e.g., photographic film, X-ray film), paper, transparencies, foil, and the like.

The problems with sheet feeders are well known, and multisheet and misaligned sheet feeding are among the more common and particularly troublesome problems. These problems are even more troublesome when the sheets are expensive, and when multisheet and misaligned feeds waste sheets that cannot be reused. For example, the sheets may be photosensitive material that may be exposed after removal from the sheet feeder. If the sheets cannot be recovered and returned to the stack of sheets without inadvertent exposure, they will be rendered unusable.

The sheet feeder art is replete with attempts to solve the multisheet and/or misaligned sheet feed problems. However, these attempts have focused on rapidly feeding inexpensive sheets (such as paper) and have misfeed rates that would not be acceptable for more expensive sheets, such as X-ray film. Further, the prior art attempts do not attempt to recover a misfed sheet and return it to the stack of sheets once it has been removed from stack of sheets.

The complexity of the multisheet feed problem is increased when there is a relatively high coefficient of friction between sheets. That is, it is more difficult to separate the sheets when they do not slide easily across the top of a stack of the sheets. This problem is particularly acute with photosensitive materials that are likely to have multiple coatings on both sides of the sheet.

Accordingly, it is an object of the present invention to provide a novel sheet feeder and method with reasonable misfeed and sheet recovery rates that obviates the problems of the prior art.

It is another object of the present invention to provide a novel sheet feeder and method in which a feed roller provides sheets to a pair of sheet separation rollers that frictionally urge a sheet therebetween along the sheet path.

It is yet another object of the present invention to provide a novel sheet feeder and method in which a pair of sheet separation rollers for frictionally urging a sheet therebetween along the sheet path each have spaced annular sheet contact surfaces that are interleaved with spaces between the annular sheet contact surfaces on the other roller so that a sheet therebetween is undulated to reduce sheet to sheet static friction.

It is still another object of the present invention to provide a novel sheet feeder and method in which a pair of sheet separation rollers for frictionally urging a sheet therebetween along the sheet path each have annular sheet contact surfaces that are spaced from the sheet contact surfaces on the other roller by a distance related to the thickness of a sheet between the rollers.

It is a further object of the present invention to provide a novel sheet feeder and method in which a pair of sheet separation rollers rotating in the same direction to frictionally urge a sheet therebetween along the sheet path include interleaved sheet contact surfaces wherein one of the rollers provides a coefficient of friction with a sheet that is more than a sheet to sheet coefficient of friction and that is less than a coefficient of friction between contact surfaces on the other roller and a sheet between the rollers.

It is yet a further object of the present invention to provide a novel sheet feeder and method in which a pair of sheet separation rollers have interleaved sheet contact surfaces that are O-rings of silicone on one roller and O-rings of buna-N on the other roller.

These and many other objects and advantages of the present invention will be readily apparent to one skilled in the art to which the invention pertains from a perusal of the claims, the appended drawings, and the following detailed description of the preferred embodiments.

FIGS. *5a–5g* are a flow diagram illustrating operation of an embodiment of the system disclosed herein.

DESCRIPTION OF PREFERRED EMBODIMENTS

Figure 1:
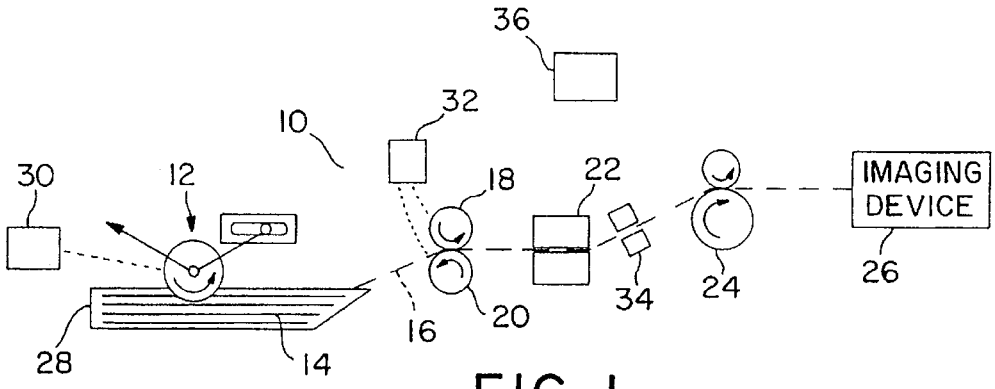
FIG. 1 is a schematic diagram of an embodiment of the sheet feeder disclosed herein.

With reference now to FIG. 1, an embodiment 10 of the sheet feeder system and method set forth herein may include a feed roller 12 that forms a nip with a sheet at the top of a stack of sheets 14, and that frictionally compels the sheet into a sheet path 16 (shown in dashed lines) when the feed roller 12 is rotated in the direction indicated by the arrow. The sheets compelled into the sheet path 16 by the feed roller 12 are routed between two separation rollers 18 and 20 that are rotated in the same direction as indicated by the arrows. The top separation roller 18 urges the sheets in contact therewith forward along the sheet path 16 (to the right in FIG. 1) to a sensor 22 that determines whether more than one sheet has been urged forward. The bottom separation roller 20 urges the sheets in contact therewith back to the stack of sheets 14. Sheets urged forward along the sheet path 16 proceed to a capstan roller 24 that assists in aligning the sheets so that they are in proper registration for an operating stage, such as an imaging device 26.

The sheets may be stacked in a removable cassette 28. The feed roller 12 may be rotated by a motor 30 that is reversible and that can stop rotation of the feed roller. The feed roller 12 may also be pivoted so that it may continue to form a nip with the top sheet as the size of the stack of sheets diminishes. The separation rollers 18 and 20 both may be operated by a motor 32 that need not be reversible. The motors 30 and 32 may be selectively disengaged from their respective rollers. A sheet trailing edge indicator 34, such as a light sensor, may be provided. Operation of the device may be controlled with a processor 36.

In normal operation, one sheet at a time proceeds from the stack of sheets 14, along the sheet path 16 to the operating stage. The motor 30 rotates the feed roller 12 in the direction indicated by the arrow to compel sheets into the sheet path, stops rotation to stop sheets from being compelled forward, and reverses rotation to recover extra sheets inadvertently compelled forward (as discussed below). The motor 32 may be rotated in one direction whenever the sheet feeder is operating and the separation rollers 18 and 20 may be selectively and separately disengaged from motor 32 to operate the sheet feeder (as discussed below). However, sheets may stick together and the feed roller 12 may inadvertently compel two sheets from the stack of sheets 14 to the separation rollers 18 and 20. The two sheets may be shingled (with staggered leading edges) or paired (with leading edges reaching the separation rollers at the same time.)

The separation rollers 18 and 20 provide a first multifeed check by frictionally urging a second sheet back toward the stack of sheets 14. The top separation roller 18 urges the sheet in contact with the top roller 18 forward along the sheet path (to the right in FIG. 1), and the bottom separation roller 20 urges the sheet in contact with the bottom roller 20 back to the stack of sheets 14 (to the left in FIG. 1). When two sheets are compelled (shingled or paired) to the separation rollers, the top sheet is urged along the sheet path and the bottom sheet is urged back. The sheet(s) urged forward by the separation roller 18 proceed to the sensor 22 that determines whether a single sheet is being urged along the sheet path. If a single sheet is being so urged, the sensor 22 provides a signal for disengaging the bottom separation roller 20 from its motor 32 (thereby allowing it to turn freely—free wheeling) so that the bottom roller 20 no longer urges the sheet backwards. The sensor 22 may also provide a signal to stop the motor 30 (desirably the same signal as used to stop motor 32) so that additional sheets are not compelled into the sheet path by the feed roller 12.

Desirably the bottom separation roller 20 provides a coefficient of friction with a sheet that is greater than a coefficient of friction between sheets so that it can separate two sheets, and the top separation roller 18 provides a coefficient of friction with a sheet that is greater than the coefficient of friction between the bottom roller 20 and a sheet so that the top roller 18 can urge a sheet forward even if only one sheet is between the rollers 18 and 20 and is being urged in both directions.

In the event the first multifeed check does not separate two sheets that have been compelled to the separation rollers 18 and 20, a second multifeed check returns both sheets toward the stack of sheets 14. When two sheets reach the sensor 22, the sensor indicates that more than one sheet is in the sheet path and provides signal(s) to disengage the top separation roller 18 from its motor 32 and to reverse the direction of rotation of the feed roller 12 so that both of the sheets between the separation rollers 18 and 20 are urged back to the stack of sheets The capstan roller 24 receives sheets from the separation roller 18 and conveys the sheets along the sheet path to an operating stage. Desirably the sheets are placed in correct registration before reaching the operating stage (for example, so that photosensitive materials are properly aligned before exposure). To this end, the capstan roller 24 may be placed so that a nip formed by the capstan roller is aligned with the operating stage. The capstan roller may form a nip across the surface of the sheets it receives, and may rotate slower than the separation rollers 18 and 20. By rotating slower, the capstan roller 24 forces sheets into better alignment. When a misaligned sheet is received at the capstan roller 24 one portion of the leading edge will enter the nip first. Because the separation rollers are rotating faster, the remainder of the leading edge will be forced forward more quickly than the portion caught by the nip of the capstan roller 24 thereby forcing it into better alignment.

Figure 2:
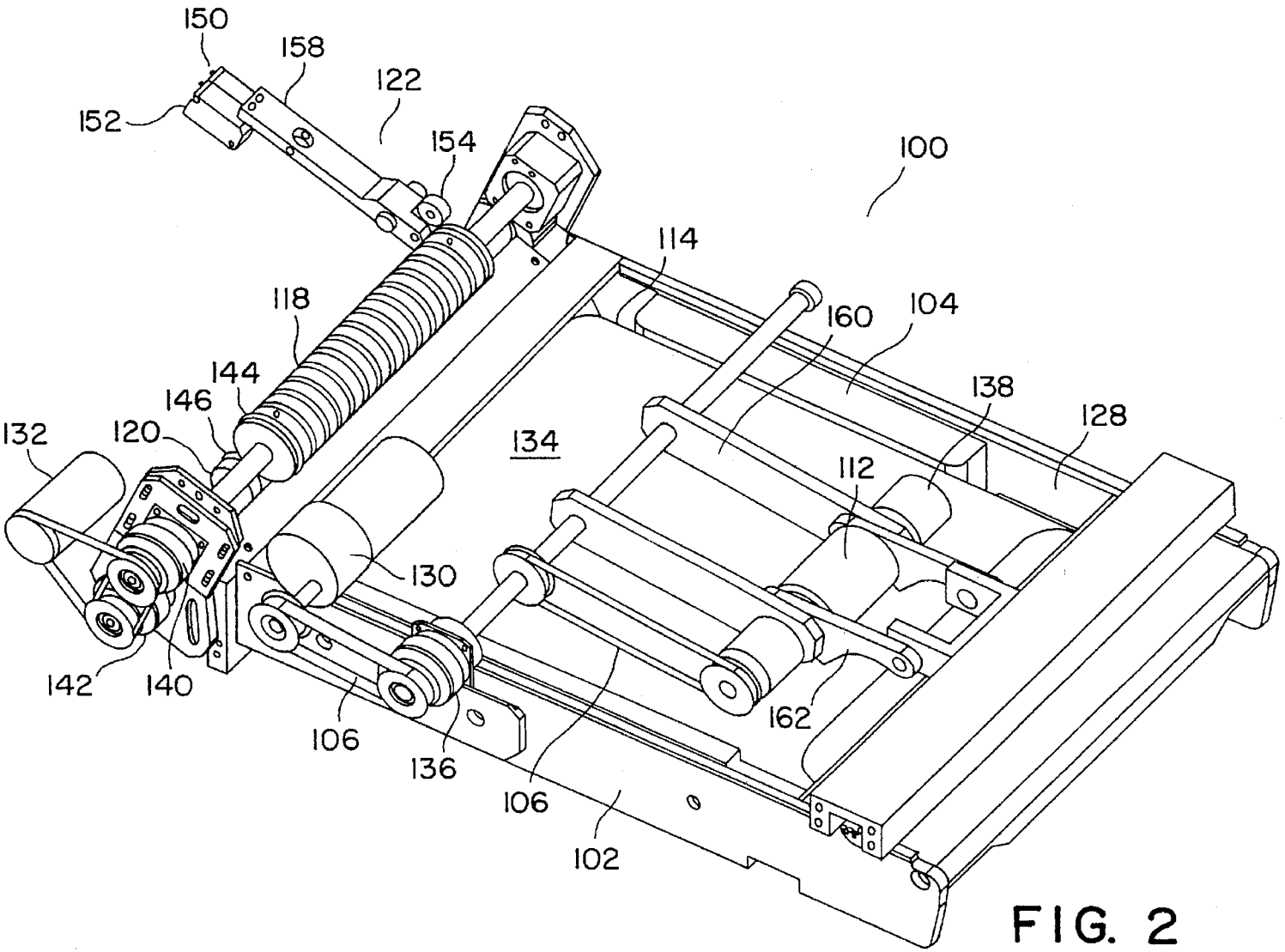
FIG. 2 is a pictorial depiction of a preferred embodiment of the sheet feeder disclosed herein.

With reference now to FIG. 2, a preferred embodiment 100 of the sheet feeder herein may include features corresponding to those discussed above, and the last two digits of the element numbers are indicative of that correspondence. A structural frame 102 may be provided to adapt the sheet feeder 100 to a particular application, and may be adapted to slidably receive a cassette 128 with the stack of sheets 114 therein. The sheets in the stack of sheets 114 may be held in proper alignment with a registration aide 104 that may apply pressure to the side of the stack of sheets 114. The registration aide 104 may be adjustable to adapt to sheets of diverse widths.

Feed roller 112 forms a nip with a top sheet 134 of the stack of sheets 114 to frictionally compel sheet 134 into a sheet path. Feed roller 112 may be rotated by a reversible DC gearmotor 130 through appropriate connections, such as the belts 106 shown. The gearmotor 130 may be selectively disengaged from the feed roller 112 by an electromechanical clutch 136. The feed roller 112 may pressurally engage the top sheet 134 to form the nip therewith and to this end may include one or more weights 138. The feed roller 112 and weights 138 may be pivotably attached to the structural frame 102 to allow the feed roller 112 to fall as the size of the stack of sheets 114 diminishes. Desirably the feed roller 112 extends at least about one-fourth the width of the sheet (e.g., two inches for an eight inch wide sheet), and may have a surface that is not likely to mar a sheet, such as polyurethane.

Sheets compelled into the sheet path by the feed roller 112 are routed between two separation rollers 118 and 120 that are rotated in the same direction by motor 132. The motor may operate in one direction and need not be stopped during normal operation. The separation rollers 118 and 120 may be disengaged from the motor 132 by electromechanical clutches 140 and 142. The separation roller 118 urges the sheets forward along the sheet path to a sensor 122 that determines whether more than one sheet has been urged. As discussed above, the top separation roller 118 urges the sheet in contact therewith forward along the sheet path, and the bottom separation roller 120 urges the sheet in contact therewith back to the stack of sheets 114.

Figure 3:
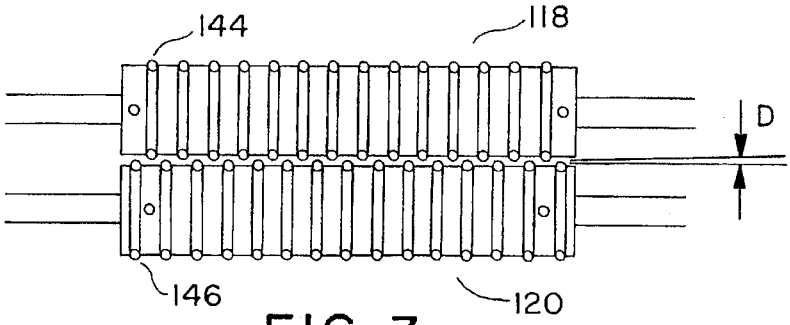
FIG. 3 is a pictorial depiction of an embodiment of the separation rollers disclosed herein.

With reference now to FIG. 3, the separation rollers 118 and 120 may each include a plurality of annular spaced-apart sheet contact surfaces 144 and 146 for contacting the sheet(s) between the separation rollers. The sheet contact surfaces 144 on roller 118 may be aligned with the spaces between the sheet contact surfaces 146 on roller 120 to thereby interleave the contact surfaces on the two rollers. Desirably the contact surfaces 144 do not touch contact surfaces 146.

Desirably the contact surfaces 146 on the bottom roller 120 provide a coefficient of friction with a sheet that is greater than a coefficient of friction between sheets so that it can separate two sheets. In a preferred embodiment that finds application for feeding sheets of photosensitive materials, the contact surfaces 146 are O-rings of silicone that may be carried in annular trenches in the roller 120. The silicone O-rings may have a Shore A hardness of 40 to 80 with 70 being preferred. The contact surfaces 144 of the top roller 118 provide a coefficient of friction with a sheet that is greater than the coefficient of friction between the contact surfaces 146 and a sheet so that the top roller 118 can urge a sheet forward even if only one sheet is between the rollers 118 and 120 and is being urged in both directions. In a preferred embodiment the contact surfaces 144 are O-rings of buna-N (nitrile). The buna-N O-rings may have a Shore A hardness of 40 to 90 with 70 being preferred. The O-rings discussed above are available from Apple Rubber Products of Lancaster N.Y. under the designations 70S (for the bottom roller) and 70BN (for the top roller).

The distance between the radially outward extent of the annular contact surfaces 144 and 146 may be set so that sheets between the rollers 118 and 120 are undulated (when viewed from the trailing or leading edges of the sheets). The forced undulation reduces the coefficient of friction so that the sheets may be more easily separated and improves the grip on the sheets. For example, the contact surfaces may overlap by a distance D less than the thickness of a sheet (preferably about one-half sheet thickness) while the contact surfaces on one roller may be spaced from a trough between contact surfaces on the other roller by more one sheet thickness.

Desirably, and to maintain better control of the sheets being urged forward, the sheet contact surfaces 144 and 146 are spaced across the width of the rollers 118 and 120 so that they contact sheets across a substantial portion of the width of the sheets (at least about two-thirds the sheet width being preferred). For example, the rollers 118 and 120 may have an axial length of about five and one-half inches for an eight inch wide sheet. The center-to-center spacing of the contact surfaces may vary, for example between about 0.2 and 0.6 inches, with 0.4 inches being preferred for thick, photosensitive media.

Figure 4:
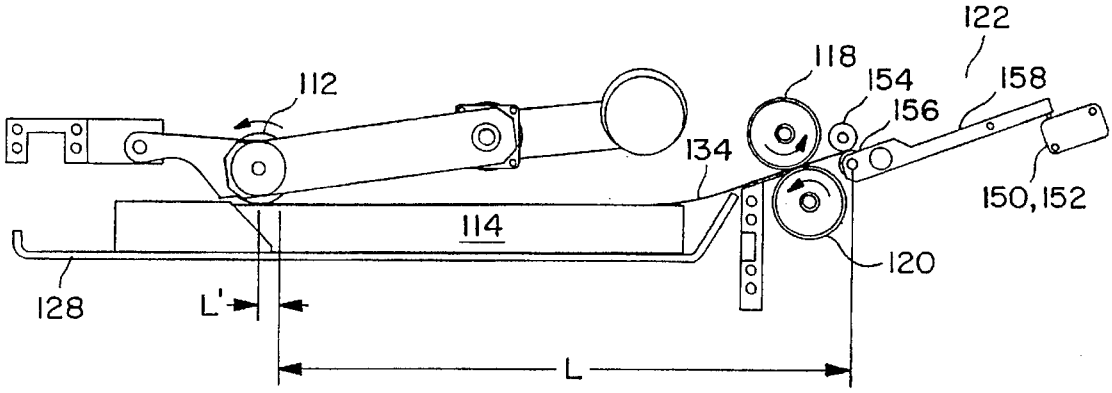
FIG. 4 is a pictorial depiction of a side view of the cassette and rollers of the embodiment of FIG. 2.

With reference now to FIG. 4, the sensor 122 may be placed to receive sheets urged forward by the separation roller 118. The sensor 122 may include two switches 150 and 152 (switch 152 being obscured in FIG. 4 and visible in FIG. 2) for sensing the number of sheets urged forward. Switch 150 may be activated when at least one sheet is urged forward, and switch 152 may be activated when more than one sheet is urged forward. Thus, two or more sheets are indicated by activation of both switches and one sheet is indicated by activation of only switch 150. This switch arrangement is compatible with the method of operating sheet feeder 100 (discussed below in relation to FIGS. 5*a*–5*g*), and other arrangements may be used. A sheet fed forward from the rollers 118 and 120 may be provided between two rolling bearings 154 and 156, with bearing 156 being adapted to move an arm 158 a distance corresponding to the combined thickness of the sheets between the bearings 154 and 156. When one sheet is between the bearings 154 and 156, the arm 158 is moved a distance sufficient to activate switch 150 (indicating at least one sheet), and when more than one sheet is between the bearings 154 and 156, the arm 158 is moved a distance sufficient to additionally activate switch 152 (indicating more than one sheet).

The sensor 122 is desirably spaced one sheet length L (measured along the curve) plus a small amount L' (e.g., a few mil) from the nip of the feed roller 112 to facilitate the operation of the sheet feeder discussed above. When one sheet 134 has been urged forward the sensor 122 provides a signal to stop rotation of the feed roller 112 so that further sheets are not urged forward (and disengaging roller 120 from motor 132 to facilitate forward movement of sheet 134.) In the event two shingled sheets are urged forward, the sensor would initially detect only a single sheet, and the transmission of signals to stop the feed roller is desirably deferred momentarily to allow time for a precautionary pull-back to return a second shingled sheet to the stack. The precautionary pull-back includes reversing the feed roller 112 and disengaging the lower separation roller 120 so that a second sheet shingled underneath sheet 134 will be urged back to the stack by the feed roller 112. The sensor 122 is thus desirably placed more than a distance L from the nip of the feed roller 112 so that the feed roller can be reversed to return the second sheet without effecting the top sheet 134. The precautionary pull-back may be made any time the sensor determines that at least one sheet has been urged forward (e.g., by activation of switch 150). In the event two paired sheets are urged forward (both switches 150 and 152 activated), the sensor 122 would indicate that the top roller 118 is to be disengaged to allow the bottom roller 120 to return the sheets to the stack and feed roller 112 may be reversed to facilitate this return.

In another embodiment, the sensor 22 may be light sensitive to measure the amount (or density) of light projected through the sheets. The light projected through one sheet will be different than the amount of light projected through two sheets and this difference may be measured with conventional light sensors. This embodiment may be appropriate for sheets through which a measurable amount of light may pass. The trailing edge detector 34 (FIG. 1) may be used as the sensor for measuring the light projected through the sheets. Alternatively, the sensor may be weight sensitive and use conventional weight detectors.

With reference again to FIG. 2, the cassette 128 may be inserted into the frame 102 to place the stack of sheets 114 under and in pressural engagement with the feed roller 112. When the cassette is being inserted it is desirable to lift the feed roller out of the way to avoid potential damage to the sheets, feed roller, and cassette. To his end, the feed roller 112 may be carried by a support 160 that includes a cam 162 for engaging the cassette 128 when the cassette is being inserted. The cam 162 pivotably moves the feed roller 112 and support 160 upwards while the cassette engages the cam 162, and thereafter allows the feed roller 112 to descend onto the stack of sheets 114.

Figure 5B:
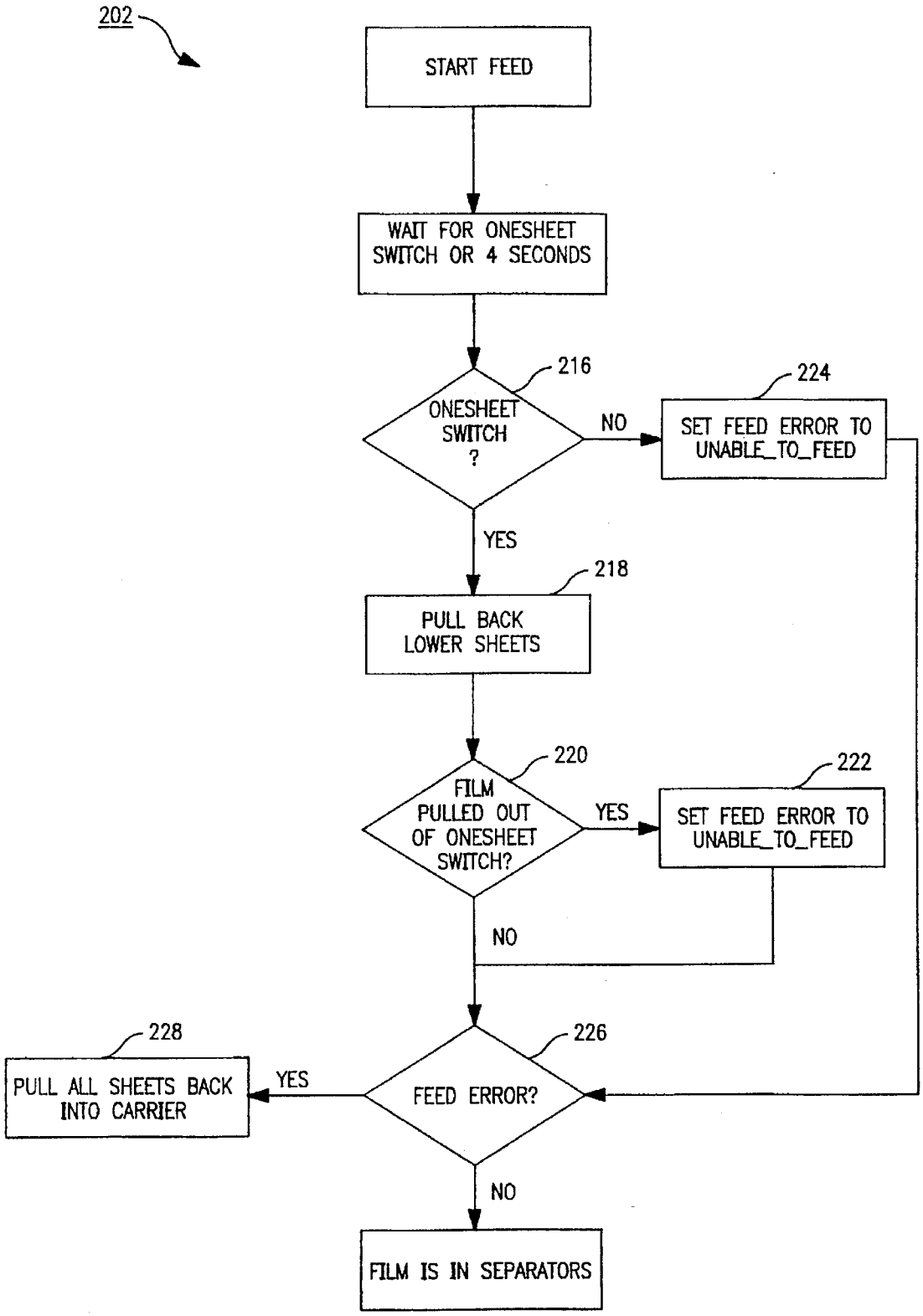

With reference now to FIGS. 5*a*–5*g*, the steps 200 of the operation of sheet feeder 100 may be more clearly seen (number elements inside the descriptive boxes relate to element numbers in FIG. 2). The steps set forth may be controlled by a conventional processor 36 (FIG. 1), or a processor configured for operation with the operating stage. FIG. 5*a* describes the main routine. Sheet feed 202 (for which see FIG. 5*b*) is initiated with the motor 132 for the separation rollers 118 and 120 turned on and clutches 140, 142, and 136 engaged. The feed roller motor 130 is on forward and sheets are compelled from the stack 114 into the sheet path. Sheets are urged along the sheet path by the rollers 118 and 120 and to sensor 122. If the sensor indicates 204 that at least one sheet has reached the separation rollers, a multifeed check 206 is performed (for which see FIGS. 5*c*, 5*d*). If the sensor indicates that a single sheet has been fed 208 (no feed error), completion of sheet feed is monitored 210 (for which see FIG. 5*e*). If a feed error has been detected, it is determined 212 whether a predetermined number of attempts (three in this embodiment) to feed a sheet have been made. If no more attempts are to be made, the appropriate indications may be made 214 to the operator through visual and/or sound signals.

Returning to step 202 (FIG. 5*b*), if an indication 216 (Yes) that at least one sheet has been urged forward is received within four seconds, normal operation continues. A precautionary pull-back is carried out in step 218 (for which see FIG. 5*f*). After the precautionary pull-back, the sensor is checked again in step 220 to be sure that at least one sheet is still present. If all sheets were pulled back in the precautionary pull-back (step 220-yes), an error is indicated in step 218 and a refeed is attempted.

If a onesheet switch indication is not received in four seconds 216 (no), it is presumed that no sheets have been compelled into the sheet path by feed roller 112 and that another attempt is to be made, and an error is indicated 224. A final feed error check is made 226, and if there has been a multifeed, all sheets are pulled back 228 (for which see FIG. 5*g*).

Figure 5C:
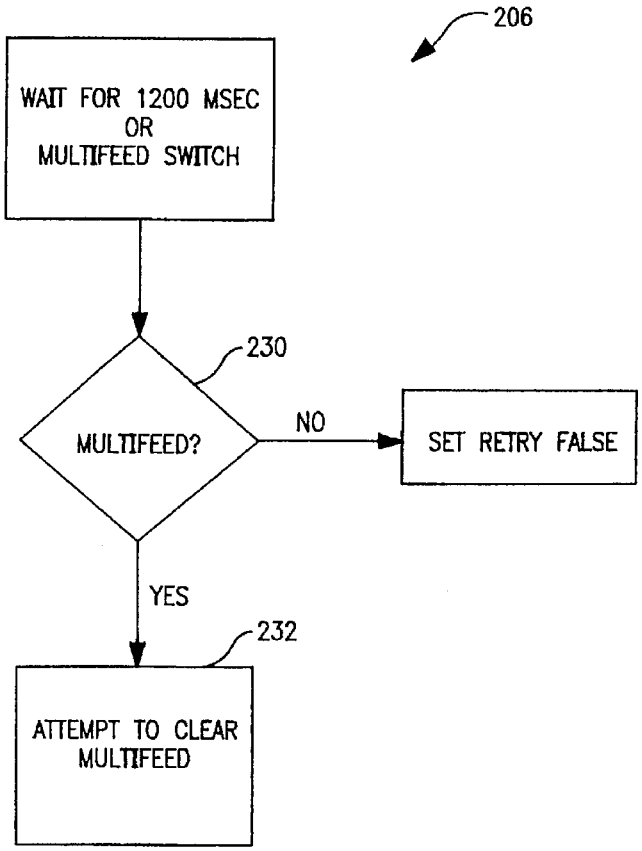
Figure 5G:
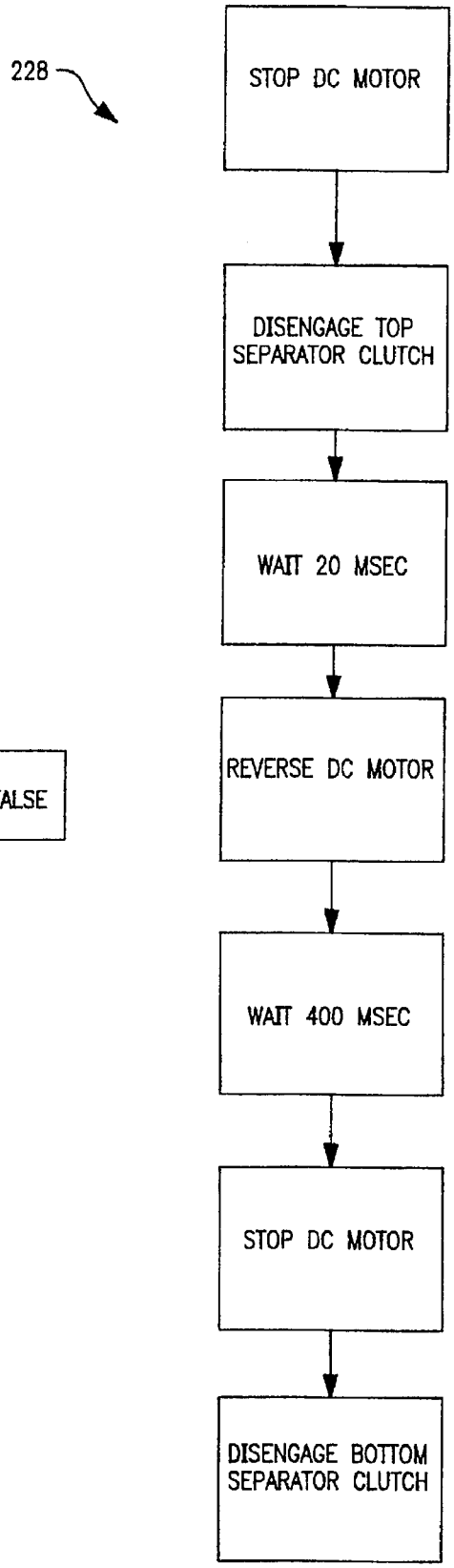
Figure 5D:
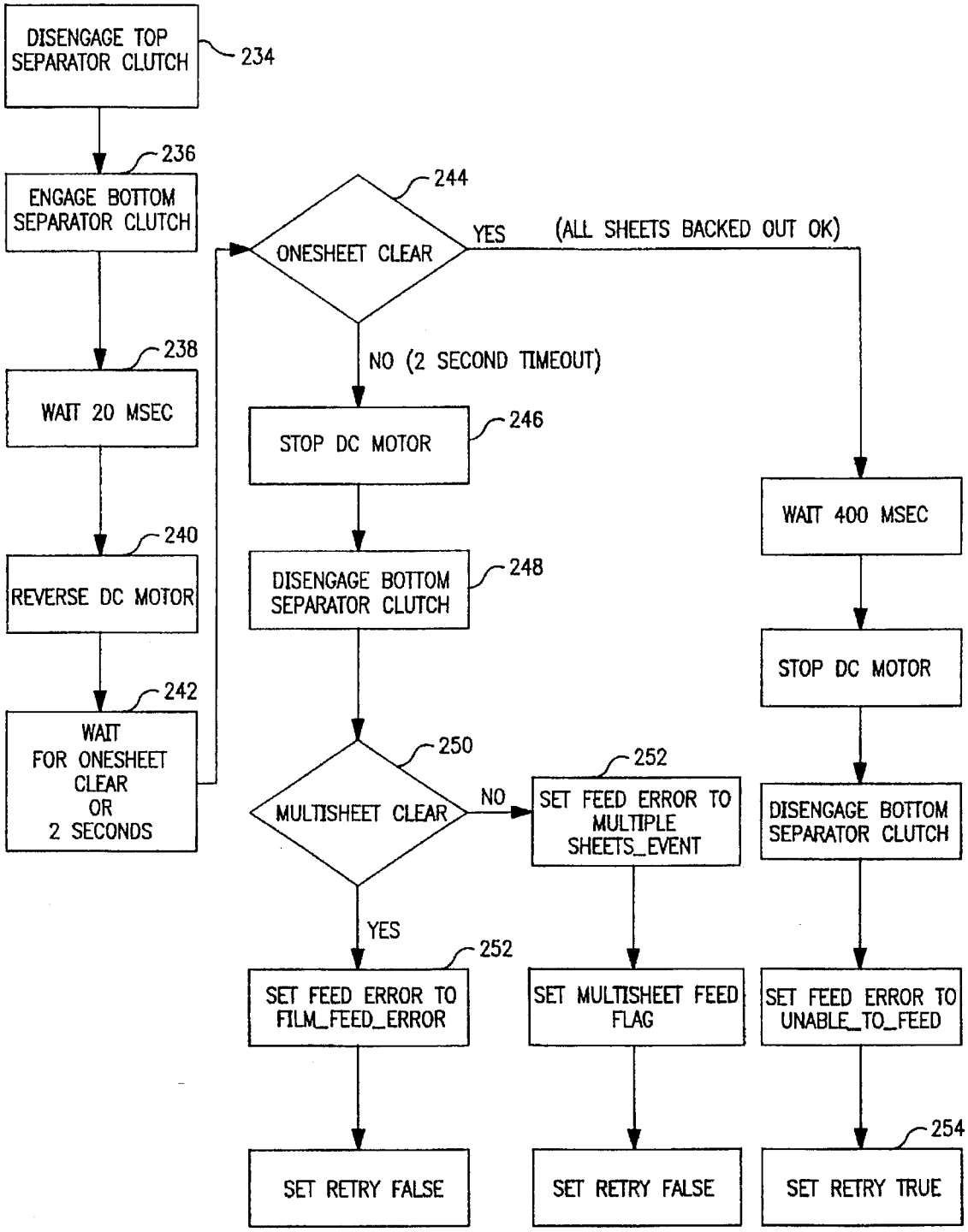

With reference now to the multifeed check of FIGS. 5*c* and 5*d*, if at least one sheet is present after the precautionary pull-back (in step 218), the second multifeed check is performed in step 206. If the sensor does not indicate that more than one sheet has been urged forward (step 230-no), that is, switch 152 has not been activated, system operation is presumed normal to this point and a refeed is not attempted. If the second multifeed check 206 indicates that more than one sheet has been urged forward (step 230-yes), a multifeed clear is attempted in step 232. A clear is attempted in steps 234–242. If the multifeed is not cleared (step 244-no), a roll forward is attempted 246–248 to send the multiple sheets forward. Regardless of whether the sheets are rolled forward 250 (yes) or not 250 (no), the feeder is presumed jammed and a retry is not attempted. Manual clearance may be required and appropriate signals (step 252) are provided to the operator. If the multifeed is cleared (step 244-yes, switches 150 and 152 deactivated), a retry may be attempted 254.

Figures 5E, 5F:
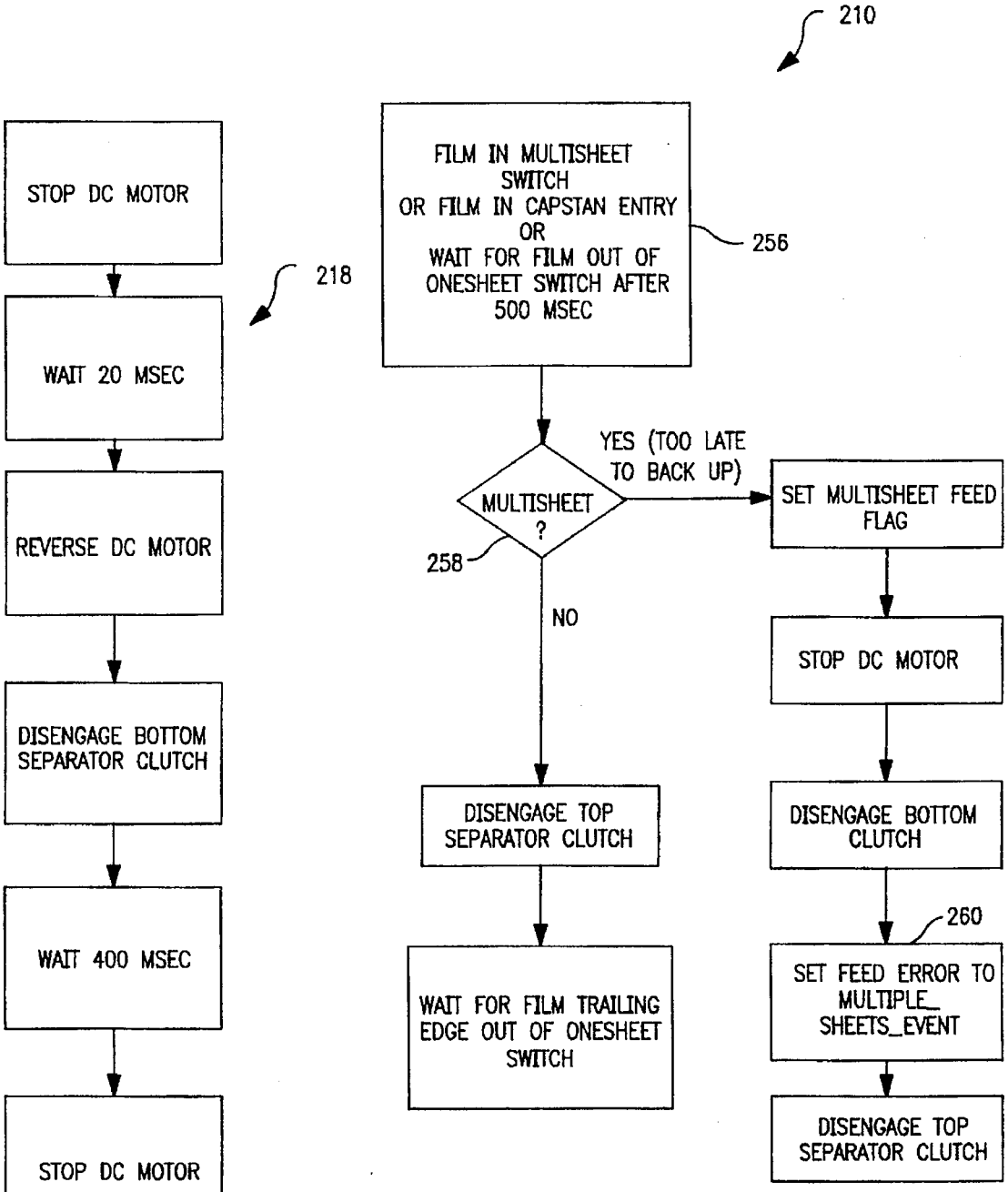

Completion of sheet feed is monitored in step 210 (FIG. 5*e*). As indicated therein, the sensor is monitored 256 until the sheet is beyond the sensors. If a multisheet indication (step 258-yes) is received now (such as when multiple sheets are rolled forward to clear a multifeed), it is too late to return the sheets to the stack and an error indication is provided 260. This indication may be used to alert the operating stage that two sheets are coming and that further operation may be aborted.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A sheet feeder for providing a sheet from a stack of sheets into a sheet path, said sheet feeder comprising:

means for compelling sheets from the stack of sheets into the sheet path;

first and second rollers for urging a sheet therebetween along the sheet path, each of said first and second rollers comprising a plurality of annular spaced-apart sheet contact O-rings for contacting a sheet in the sheet path, said sheet contact O-rings on said first roller being aligned with spaces between said sheet contact O-rings on said second roller, said first roller sheet contact O-rings for providing a coefficient of friction between said first roller sheet contact O-rings and the sheet between said rollers that is less than a coefficient of friction provided by said second roller sheet contact O-rings and a sheet between said rollers; and means for rotating said first and second rollers in the same direction, whereby in the event two sheets are in the sheet path between said two rollers the coefficients of friction cause only the sheet adjacent said second roller to be urged along the sheet path.

2. The sheet feeder of claim 1 wherein the radially outward extent of said sheet contact O-rings on said first roller overlaps the radially outward extent of said sheet contact O-rings on said second roller by a distance that is less than a thickness of a sheet between said rollers, whereby in the event two sheets are compelled between said rollers the two sheets assume a sinuous shape for reducing the coefficient of friction therebetween.

3. The sheet feeder of claim 1 wherein said plurality of sheet contact O-rings on said first and second rollers are spaced across the width of a sheet between said rollers.

4. The sheet feeder of claim 1 wherein said O-rings for said first roller comprise silicone, and wherein said O-rings for said second roller comprise buna-N.

5. The sheet feeder of claim 1 wherein, said first roller sheet contact O-rings provide a coefficient of friction with a sheet contacting said first roller sheet contact O-rings that is greater than a coefficient of friction between sheets from the stack of sheets.

6. The sheet feeder of claim 1 wherein said sheet contact O-rings of said first roller do not contact said sheet contact O-rings of said second roller.

7. A sheet feeder for urging a sheet along a sheet path, said sheet feeder comprising:

first and second rollers for rotating in the same direction to urge a sheet therebetween along the sheet path, each of said rollers further comprising plural radially extended O-rings for contacting a sheet between said rollers that are interleaved with gaps between said O-rings on the other of said rollers, said plural O-rings on said first and second rollers being spaced substantially across the width of a sheet between said rollers, said plural O-rings on said first roller comprising silicone and not contacting said plural O-rings on said second roller, said first roller providing a first frictional force between said first roller and a sheet between said rollers that is less than a second frictional force between said second roller and a sheet between said rollers.

8. The sheet feeder of claim 7 wherein said first and second rollers are at least about two-thirds as wide as the sheet therebetween.

9. The sheet feeder of claim 7 wherein said plural O-rings of said first roller are spaced from troughs between said plural O-rings of said second roller by a distance greater than a thickness of a sheet therebetween.

10. The sheet feeder of claim 7 wherein said O-rings for said second roller comprise buna-N.

11. The sheet feeder of claim 7 wherein said plural O-rings are between 0.2 and 0.6 inches center to center.

12. The sheet feed of claim 11 wherein said plural O-rings are about 0.4 inches center to center.

13. A sheet feeder for urging sheets along a sheet path, said sheet feeder comprising:

first and second rollers for frictionally urging a sheet therebetween along the sheet path, each of said rollers comprising plural spaced annular sheet contact O-rings that are interleaved with spaces between said sheet contact O-rings on the other of said rollers, the radially outward extent of said contact O-rings on said first roller overlapping the radially outward extent of said contact O-rings on said second roller, whereby in the event more than one of the sheets are between said rollers, said ridges decrease a coefficient of friction between the sheets by causing an undulation of the sheets.

14. The sheet feeder of claim 13 wherein said plural contact O-rings on said first and second rollers are spaced across the width of a sheet between said rollers.

15. The sheet feeder of claim 13 further comprising means for rotating said first and second rollers in the same direction, and wherein said contact O-rings on said first roller provide a coefficient of friction with a sheet between said rollers that is less than a coefficient of friction between said contact O-rings on said second roller and a sheet between said rollers.

16. The sheet feeder of claim 13 wherein said sheet contact O-rings comprise silicone.

* * * * *